US009459574B1

(12) United States Patent
Sunohara et al.

(10) Patent No.: US 9,459,574 B1
(45) Date of Patent: Oct. 4, 2016

(54) IMAGE FORMING APPARATUS AND IMAGE FORMING SYSTEM FOR CORRECTING CURVATURE OF A RECORDING SHEET

(71) Applicant: FUJI XEROX CO., LTD., Tokyo (JP)

(72) Inventors: Tsuyoshi Sunohara, Kanagawa (JP); Yasutaka Naito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/796,032

(22) Filed: Jul. 10, 2015

(30) Foreign Application Priority Data

Mar. 27, 2015 (JP) ..... 2015-067397

(51) Int. Cl.
*G03G 15/20* (2006.01)

(52) U.S. Cl.
CPC ..... *G03G 15/2085* (2013.01)

(58) Field of Classification Search
CPC ..... G03G 15/2085
See application file for complete search history.

(56) References Cited

U.S. PATENT DOCUMENTS

2001/0024013 A1* 9/2001 Horikoshi ..... B65H 5/025 271/272
2004/0185993 A1* 9/2004 Doi ..... B65H 45/14 493/231
2005/0207811 A1* 9/2005 Kimura ..... G03G 15/6529 399/401

FOREIGN PATENT DOCUMENTS

JP 2000-155505 A 6/2000
JP 2004-294855 A 10/2004
JP 2005255386 A * 9/2005

OTHER PUBLICATIONS

Machine translation of JP 2000-155505.*

* cited by examiner

*Primary Examiner* — G. M. Hyder
(74) *Attorney, Agent, or Firm* — Sughrue Mion, PLLC

(57) ABSTRACT

An image forming apparatus includes a toner image forming unit that forms a toner image on a recording medium, a fixing unit that heats and fixes the toner image onto the recording medium, an ejection unit that ejects the recording medium through a curved transport path, a transport unit for two-sided printing that flips over the recording medium and transports the recording medium to the toner image forming unit, and a switching unit that switches, when an subsequent operation is specified to be performed on the recording medium, an ejection path through which the recording medium is to be ejected to an ejection path that passes the transport unit for two-sided printing and changes a temperature of the fixing unit to a temperature lower than a temperature at which the toner image is fixed to the recording medium or causes the fixing unit to stop heating.

5 Claims, 11 Drawing Sheets

IMAGE FORMING APPARATUS AND IMAGE FORMING SYSTEM FOR CORRECTING CURVATURE OF A RECORDING SHEET

CROSS-REFERENCE TO RELATED APPLICATIONS

This application is based on and claims priority under 35 USC 119 from Japanese Patent Application No. 2015-067397 filed Mar. 27, 2015.

BACKGROUND

Technical Field

The present invention relates to an image forming apparatus and an image forming system.

SUMMARY

According to an aspect of the invention, there is provided an image forming apparatus including a toner image forming unit that forms a toner image on a recording medium, a fixing unit that heats and fixes the toner image, which has been formed on the recording medium by the toner image forming unit, onto the recording medium, an ejection unit that ejects the recording medium, to which the toner image has been fixed by the fixing unit, through a curved transport path, a transport unit for two-sided printing that flips over the recording medium, to which the toner image has been fixed by the fixing unit, and transports the recording medium to the toner image forming unit, and a switching unit that switches, when an subsequent operation is specified to be performed on the recording medium, to which the toner image has been fixed by the fixing unit, an ejection path through which the recording medium is to be ejected to an ejection path that passes the transport unit for two-sided printing and changes a temperature of the fixing unit to a temperature lower than a temperature at which the toner image is fixed to the recording medium or causes the fixing unit to stop heating.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

First Exemplary Embodiment

Figure 1:
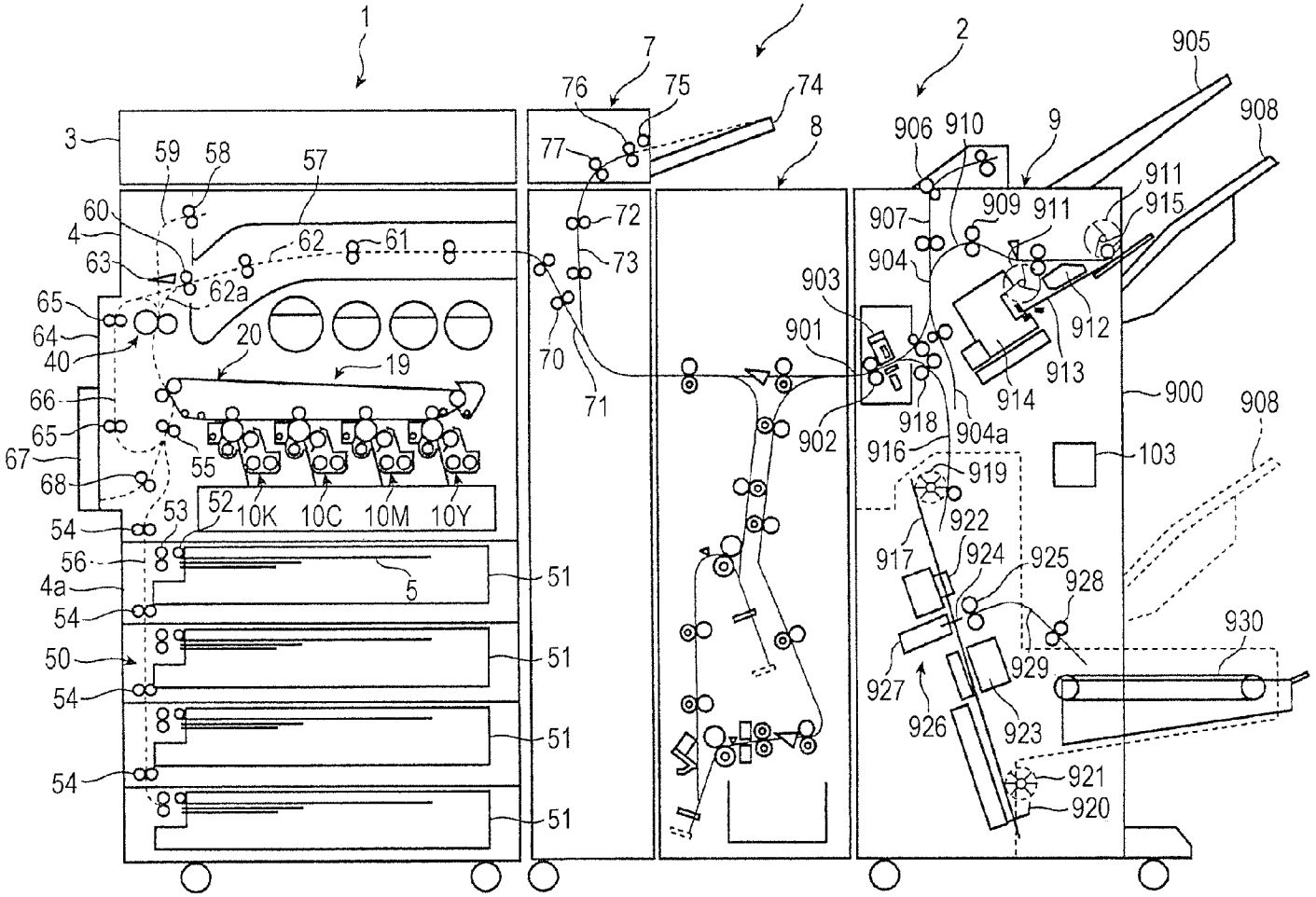
FIG. 1 is an overall configuration diagram of an image forming system that includes an image forming apparatus according to a first exemplary embodiment of the present invention.

FIG. 1 is a diagram illustrating an overview of an image forming system that includes an image forming apparatus according to a first exemplary embodiment of the present invention.

<Overall Configuration of Image Forming System>

As illustrated in FIG. 1, an image forming system 100 includes an image forming apparatus 1 that forms images on recording sheets 5, each of which is an example of a recording medium, and a subsequent operation device 2 that performs, on the recording sheets 5, on each of which an image has been formed by the image forming apparatus 1, subsequent operations, such as a slip-sheet operation that inserts a different sheet between the recording sheets 5, a folding operation, a punching operation, and a binding operation. The subsequent operation device 2 includes a sheet-supply device 7, which is a device called an interposer that supplies a front cover, a back cover, an index sheet, and the like, a folding device 8 that performs a folding operation, on the recording sheets 5, such as a half fold, a letter fold called a C fold, an accordion fold called a Z fold, and folding in four, and a finisher 9 that performs, on the recording sheets 5, subsequent operations, such as a punching operation, a binding operation, and a folding operation.

The image forming apparatus 1 is configured as, for example, a color printer. The image forming apparatus 1 includes an image reading device 3 that reads an image of a document and an image output device 4 that forms an image by using toners of four colors of yellow (Y), magenta (M), cyan (C), and black (K).

The image output device 4 includes an image forming unit 19 that employs an electrophotographic system and forms an image (unfixed image) on one of the recording sheets 5 on the basis of image data, the image forming unit 19 being an example of a toner image forming unit. The image forming unit 19 includes plural image forming devices 10 that form toner images, which are developed with toners included in developers, and an intermediate transfer device 20 that holds toner images formed by the image forming devices 10 and eventually transports the toner images to a second transfer position at which the toner images are to be transferred in a second transfer process onto one of the recording sheets 5. The image output device 4 further includes a sheet-feeding device 50 that feeds one of the recording sheets 5 that is to be supplied to the second transfer position of the intermediate transfer device 20 and a fixing device 40 that heats the recording sheet 5, on which toner images have been formed by the image forming unit 19, and fixes the toner images onto the recording sheet 5. In FIG. 1, reference numeral 4*a* denotes a housing of the image output device 4, and the housing 4*a* is formed of a support member, an exterior cover, and the like.

The image forming devices 10 include four image forming devices 10Y, 10M, 10C, and 10K that respectively form toner images of the four colors of Y, M, C, and K. The four image forming devices 10 (Y, M, C, and K) are arranged in a row in such a manner as to be equally spaced in an internal space of the housing 4*a*.

Figure 2:
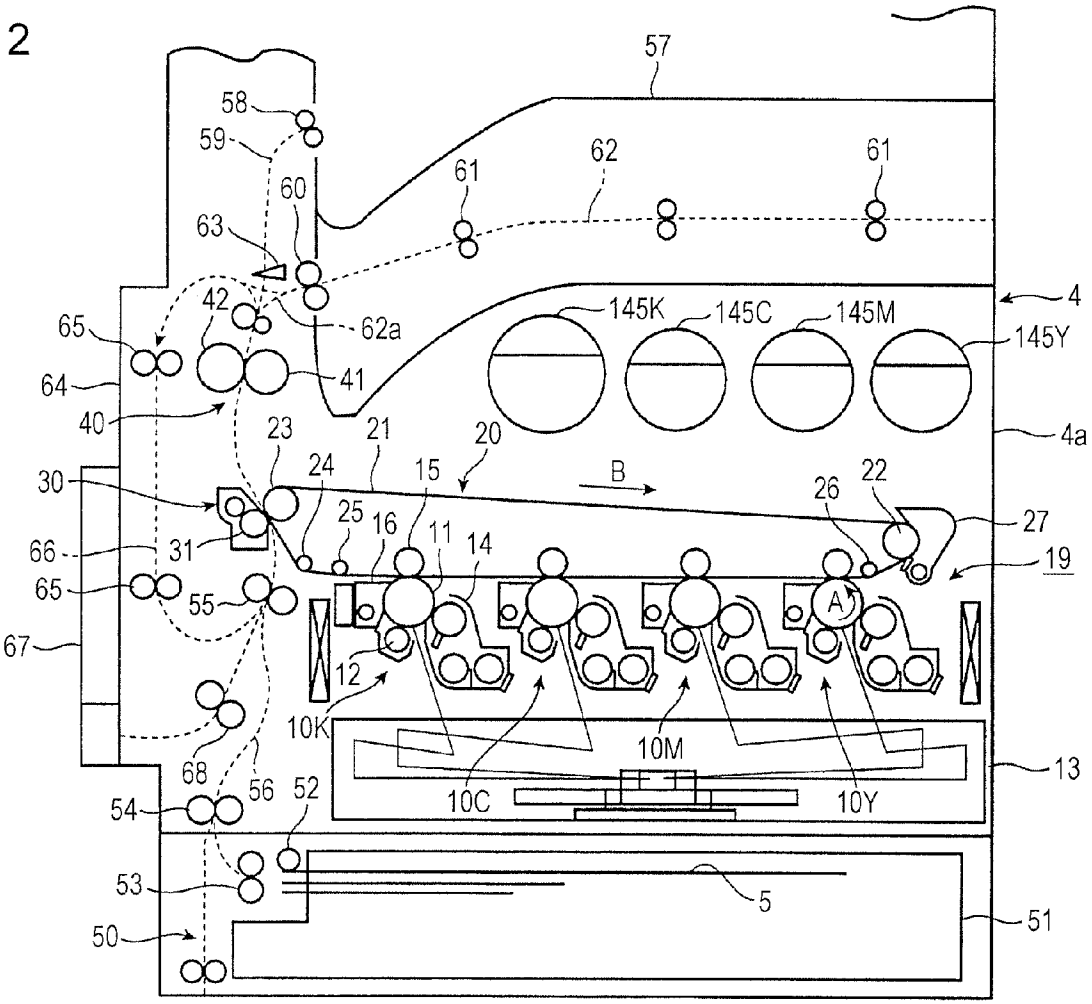
FIG. 2 is a configuration diagram of the image forming apparatus according to the first exemplary embodiment of the present invention.

As illustrated in FIG. 2, each of the image forming devices 10 includes a photoconductor drum 11, which is an example of an image carrier that rotates, and the following devices are disposed around each of the photoconductor drums 11: a charging device 12 that charges a circumferential surface (image-holding surface) of the photoconductor drum 11 on which an image may be formed to a certain electric potential, a developing device 14 that is an example of a developing unit that develops an electrostatic latent image, which is formed by an exposure device 13, into a toner image with a corresponding one of the four color toners included in the developers, a first transfer device 15 that transfers the toner image onto the intermediate transfer device 20, a drum cleaning device 16 that cleans the image-holding surface of the photoconductor drum 11 by removing attached substances such as residual toner deposited on the image-holding surface of the photoconductor drum 11 after a first transfer process, and the like. The exposure device 13 that serves as an electrostatic-latent-image forming unit and radiates light based on image information (signal) onto the charged circumferential surfaces of the photoconductor drums 11 so as to form electrostatic latent images (of different colors) having electric potential differences is disposed below the image forming devices 10.

As illustrated in FIG. 1 and FIG. 2, the intermediate transfer device 20 is disposed above the image forming devices 10 (Y, M, C, and K). The intermediate transfer device 20 includes an intermediate transfer belt 21 that rotates in a direction indicated by arrow B while passing through first transfer positions between the photoconductor drums 11 and the corresponding first transfer devices 15 (first transfer rollers), plural belt support rollers 22 to 26 that hold, from a space enclosed by the intermediate transfer belt 21, the intermediate transfer belt 21 so as to bring the intermediate transfer belt 21 into a desired state and that rotatably supports the intermediate transfer belt 21, a second transfer device 30 that is disposed adjacent to a portion of an outer peripheral surface (image-holding surface) of the intermediate transfer belt 21 supported by the belt support roller 23 and that transfers toner images formed on the intermediate transfer belt 21 onto one of the recording sheets 5 in a second transfer process, and a belt cleaning device 27 that cleans the outer peripheral surface of the intermediate transfer belt 21 by removing attached substances such as residual toner and paper dust deposited on the outer peripheral surface of the intermediate transfer belt 21 after the intermediate transfer belt 21 has passed through the second transfer device 30.

An endless belt made of, for example, a material formed by dispersing a resistance-adjusting agent, such as carbon black, or the like throughout a synthetic resin, such as a polyimide resin or a polyamide resin, is used as the intermediate transfer belt 21. The belt support roller 22 is configured as a driving roller, the belt support roller 23 is configured as a backup roller used in a second transfer process, the belt support roller 24 is configured as a tension-applying roller, and the belt support rollers 25 and 26 are configured as driven rollers that maintain a movement position of the intermediate transfer belt 21.

As illustrated in FIG. 2, the second transfer device 30 is a contact-type transfer device that includes a second transfer roller 31. The second transfer roller 31 rotates while being in contact with the peripheral surface of the intermediate transfer belt 21 at the second transfer position, which is a portion of the outer peripheral surface of the intermediate transfer belt 21 supported by the belt support roller 23 in the intermediate transfer device 20, and is supplied with a voltage for a second transfer process. A direct-current voltage having a polarity opposite to or the same as the charge polarity of the toners, is supplied, as the voltage for a second transfer process, to the second transfer roller 31 or the belt support roller 23 of the intermediate transfer device 20.

The fixing device 40 includes a fixing belt 41, which is an example of a rotating body for heating, and a pressure roller 42, which is an example of a rotating body for applying pressure. A portion where the fixing belt 41 and the pressure roller 42 are in contact with each other forms a fixing treatment portion that fixes toner images onto one of the recording sheets 5. The structure of the fixing device 40 will be described in detail later.

The sheet-feeding device 50 is disposed below the image forming devices 10 (Y, M, C, and K), which respectively correspond to the colors Y, M, C, and K. The sheet-feeding device 50 includes one or more sheet-accommodating units 51, in each of which a desired type of the recording sheets 5 each having a desired size and the like are accommodated in a state of being stacked on top of one another, and delivery units 52 and 53 that send out the recording sheets 5 one by one from the one or more sheet-accommodating units 51. The one or more sheet-accommodating units 51 are mounted in such a manner as to, for example, be capable of being drawn out toward the front surface (surface that faces a user during an operation) of the housing 4*a*.

Examples of the recording sheets 5 include thick paper, such as normal sheets and coated sheets, and thin paper, such as tracing paper, that are used in a copying machine, a printer, and the like that employ an electrophotographic system.

A sheet-feeding transport path 56 that includes one or more pairs of sheet-transport rollers 54 and one or more pairs of sheet-transport rollers 55 that transport one of the recording sheets 5, which is sent out from the sheet-feeding device 50, to the second transfer position and a transport guide (not illustrated) is arranged between the sheet-feeding device 50 and the second transfer device 30. The one or more pairs of sheet-transport rollers 55 are configured as, for example, rollers (registration rollers) that adjust the timing at which one of the recording sheets 5 is transported. A curved first ejecting-transport path 59 along which the recording sheet 5, which has been sent out from the fixing device 40 and to which toner images have been fixed, is ejected to a sheet-ejecting section 57 disposed above the housing 4*a* by using a pair of sheet-ejection rollers 58 and a second ejecting-transport path 62 that includes a curved portion 62*a* and that is used for ejecting one of the recording sheets 5 to the subsequent operation device 2 by using a pair of sheet-ejection rollers 60 and pairs of sheet-ejection rollers 61 are arranged so as to be in communication with sheet-ejection ports that are formed in the housing 4*a* of the image output device 4.

A switching gate 63 that performs switching of a sheet-transport path is disposed between the fixing device 40 and the pair of sheet-ejection rollers 60. The direction in which the pair of sheet-ejection rollers 60 rotate may be switched between a forward direction (ejection direction) and a reverse direction. In the case of forming an image on the two surfaces of one of the recording sheets 5, after a trailing end of the recording sheet 5, which has a surface on which an image has been formed, has passed through the switching gate 63, the direction in which the pair of sheet-ejection rollers 60 rotates is switched from the forward direction (ejection direction) to the reverse direction. As a result of the sheet-transport path being switched by the switching gate 63, the recording sheet 5 that is transported by the pair of sheet-ejection rollers 60 in the reverse direction is transported to a two-sided printing transport device 64 that is an example of a transport unit for two-sided printing and that is disposed along a substantially vertical direction. The two-sided printing transport device 64 includes a pair of sheet-transport rollers 65 that transports one of the recording sheets 5 to the one or more pairs of sheet-transport rollers 55 in a state where the recording sheet 5 is flipped over and a two-sided printing transport path 66 that includes a transport guide (not illustrated).

Note that, in FIG. 2, reference numeral 67 denotes a manual feed tray, and one of the recording sheets 5 that is fed from the manual feed tray 67 is transported to the one or more pairs of sheet-transport rollers 55 via a pair of sheet-transport rollers 68.

In FIG. 2, reference numerals 145Y, 145M, 145C, and 145K denote plural toner cartridges that are arranged along a direction perpendicular to FIG. 2 and that contains developers, each of which contains at least a toner and each of which is to be supplied to a corresponding one of the developing devices 14 (Y, M, C, and K). Each of the toner cartridges is an example of a developer container.

<Configuration of Fixing Device>

Figure 3:
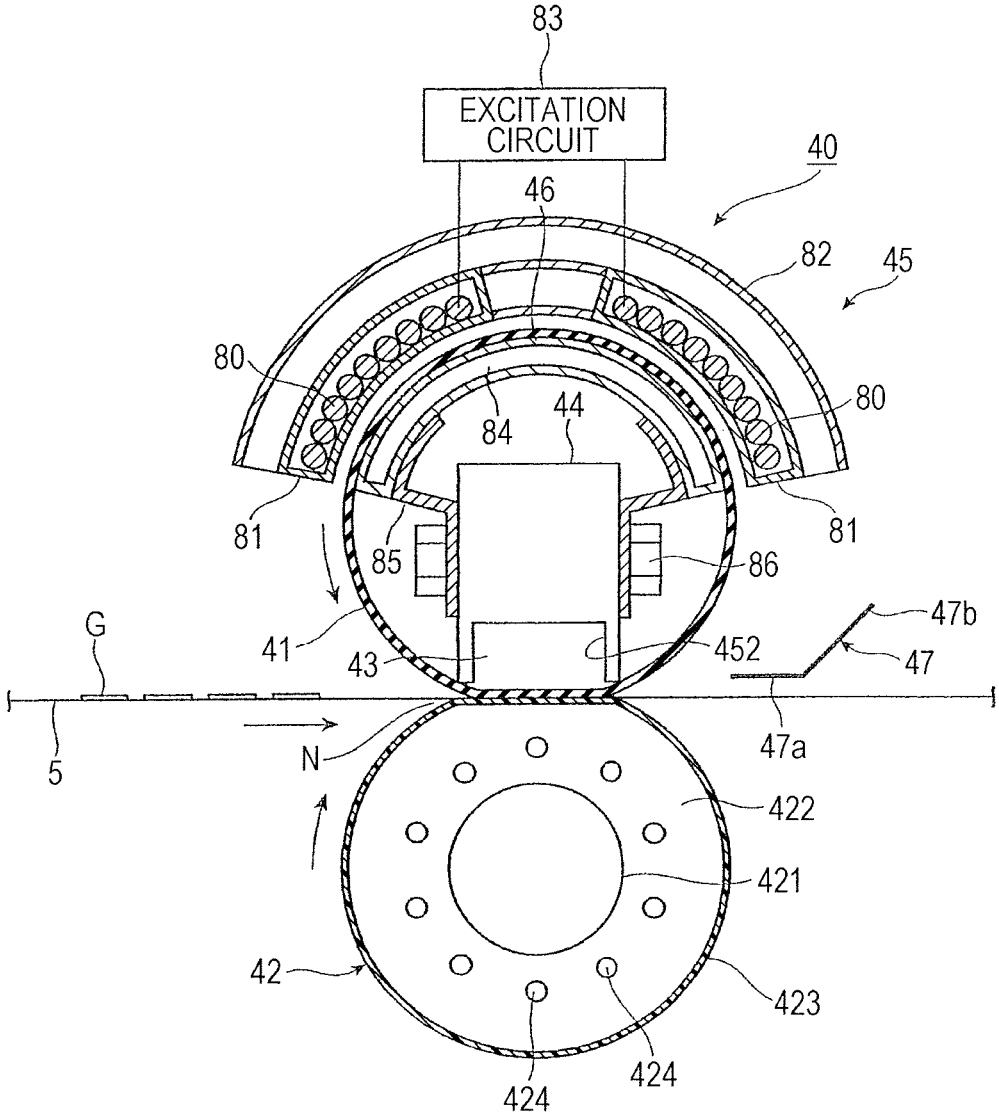
FIG. 3 is a configuration diagram of a fixing device.

FIG. 3 is a cross-sectional view illustrating the configuration of the fixing device 40 that is used in the image output device 4, which has the above-described configuration.

As illustrated in FIG. 3, the fixing device 40 includes the fixing belt 41 that is an endless belt, which is to be heated, the pressure roller 42 that is a pressure rotating body and that rotates in a state where one of the recording sheets 5, which holds an unfixed toner image G, is nipped in a press-contact portion (nip part) N, which is defined between the fixing belt 41 and the pressure roller 42, a pressure pad 43 that is a pressing member and that causes the fixing belt 41 to be pressed into contact with the pressure roller 42, and a support member 44 that supports the pressure pad 43.

The fixing device 40 includes an alternating-magnetic-field-generating device 45 that is disposed in such a manner as to face a portion of the outer peripheral surface of the fixing belt 41 on the side opposite to the nip part N and to be separated from the portion by a predetermined distance and that generates an alternating magnetic field, which heats the fixing belt 41 by electromagnetic induction, a heat-storage member 46 that is disposed in a space enclosed by the fixing belt 41 in such a manner as to be in contact with the fixing belt 41 and to face the alternating-magnetic-field-generating device 45 with the fixing belt 41 interposed therebetween and that stores heat generated by the fixing belt 41, and a separation-supporting member 47 that helps separate one of the recording sheets 5 from the fixing belt 41.

Figure 4:
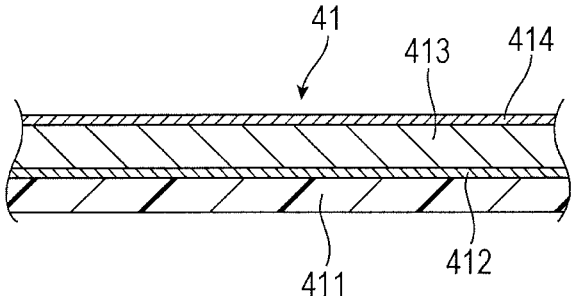
FIG. 4 is a sectional view illustrating a configuration of a fixing belt.

The cross-sectional shape of the fixing belt 41, before the fixing belt 41 is deformed as a result of the pressure roller 42 being pressed into contact with the fixing belt 41, is a thin-walled cylindrical shape having an outer diameter of about 20 to 50 mm. In the first exemplary embodiment, the outer diameter of the fixing belt 41 is set to about 30 mm. As illustrated in FIG. 4, the fixing belt 41 includes, for example, a base layer 411, a thermal layer 412, an elastic layer 413, and a surface-release layer 414 that are sequentially stacked on the outer peripheral surface of the base layer 411. However, the fixing belt 41 may include a protective layer formed on the outer periphery of the thermal layer 412, and the configuration of the protective layer is arbitrary.

As illustrated in FIG. 3, the pressure roller 42 includes a core bar 421 that is made of a metal, such as stainless steel and aluminum and that has a columnar shape, an elastic-body layer 422 that is made of a silicone rubber or the like and that has heat resistance, the elastic-body layer having a predetermined thickness and covering a surface of the core bar 421, and a release layer 423 that is made of a material having good releasability, such as polytetrafluoroethylene perfluoroalkoxyethylene copolymer (PFA), the release layer 423 having a thickness of, for example, about 50 μm and covering a surface of the elastic-body layer 422. The pressure roller 42 is formed in, for example, a substantially solid columnar shape having an outer diameter of about 28 mm.

The pressure pad 43, which causes the fixing belt 41 to be pressed into contact with the pressure roller 42, is formed of, for example, an elastic body made of a material having heat resistance, such as a silicone rubber or a fluoro rubber, and as illustrated in FIG. 3, the pressure pad 43 is mounted in such a manner as to be fitted to a recess 52, which is formed in the support member 44 at a position facing the pressure roller 42. The pressure pad 43 is a member that forms the nip part N between the fixing belt 41 and the pressure roller 42 by being pressed into contact with the pressure roller 42 with the fixing belt 41 interposed therebetween.

As illustrated in FIG. 3, the support member 44 is formed so as to have a rectangular shape when viewed in cross section in order to have rigidity such that a deflection amount of the support member 44 when the support member 44 receives a press-contact force from the pressure roller 42 via the pressure pad 43 is a predetermined value or lower. The support member 44 is made of a material that will not affect or is less likely to affect an induction field, and for example, a heat-resistant resin, such as polyphenylene sulfide resin (PPS) into which glass fibers are mixed, a non-magnetic metal material, such as, aluminum, or the like is used.

Figure 5:
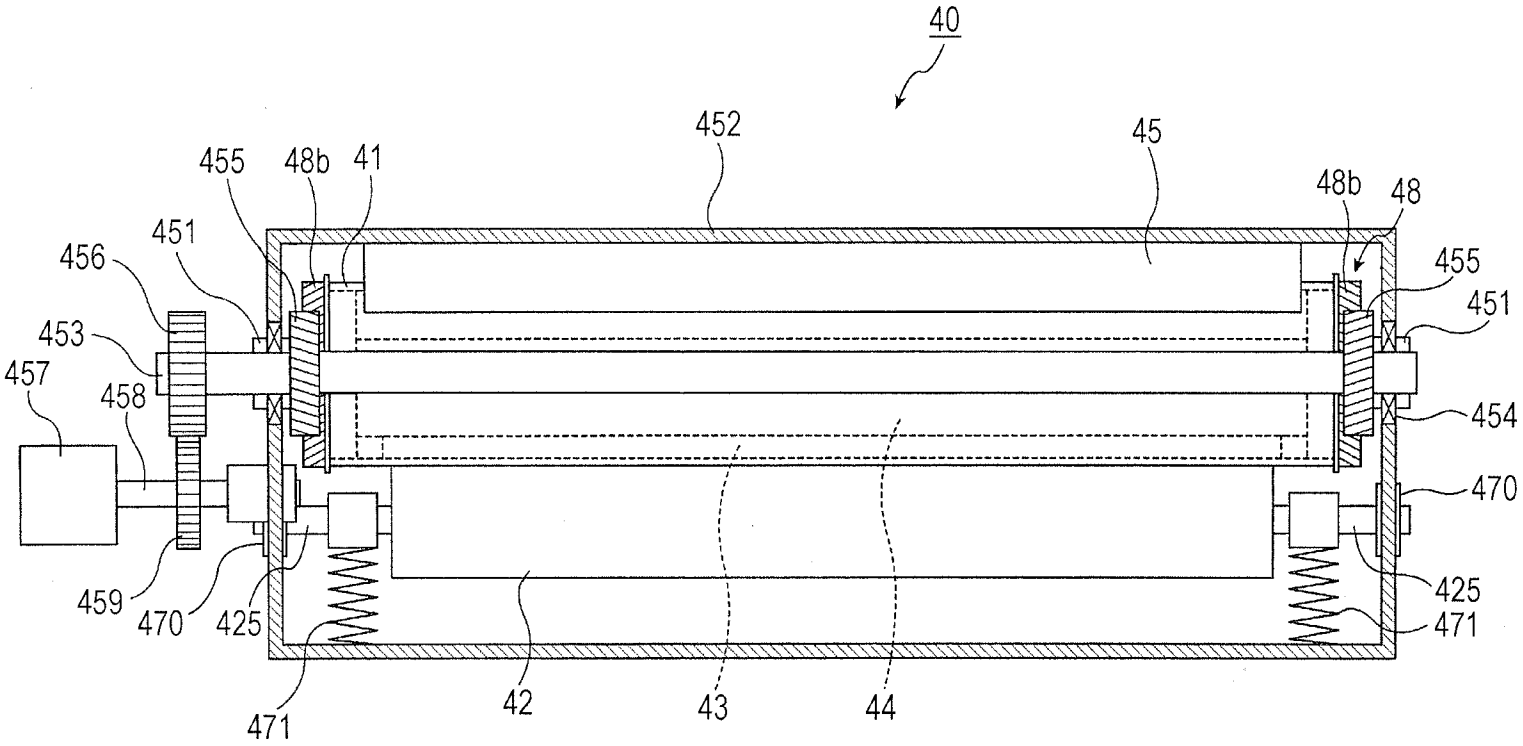
FIG. 5 is a cross-sectional view illustrating a configuration of the fixing device.

As illustrated in FIG. 5, the fixing device 40 includes a device frame 452, which is a frame body formed in a rectangular shape having a long length. Anchored portions 451, which are disposed on the opposite end portions of the support member 44, are fixedly mounted on the device frame 452, and the fixing belt 41 is rotatably disposed over the outer periphery of a support portion of the support member 44 with a bearing member (not illustrated) interposed therebetween.

As illustrated in FIG. 5, the opposite end portions of a drive shaft 453 that drives the fixing belt 41 so that the fixing belt 41 rotates are rotatably mounted on the device frame 452 via bearing members 454. Driven gears 455 that engage with driving portions 48*b* of flange members 48, which are positioned at the opposite ends of the fixing belt 41, are mounted on end portions of the drive shaft 453, which are positioned within the device frame 452. A transmission gear 456 that transmits a driving force to the drive shaft 453 is mounted on one end portion of the drive shaft 453 positioned outside the device frame 452, and a drive gear 459, which is fixed to a rotary shaft 458 of a drive motor 457, engages with the transmission gear 456. A proximal end portion of the rotary shaft 458 of the drive motor 457 is rotatably mounted on the device frame 452 of the fixing device 40. In the fixing device 40, as a result of the drive motor 457 being driven so as to rotate, a rotational driving force of the drive motor 457 is transmitted to the drive shaft 453 via the drive gear 459 and the transmission gear 456, so that the driven gears 455, which are mounted on the drive shaft 453, are caused to rotate, and the fixing belt 41 is driven so as to rotate at a predetermined rotation speed by the driving portions 48*b* of the flange members 48, which engage with the driven gears 455 and which are disposed on the opposite end portions of the fixing belt 41.

Note that, as described above, since the fixing belt 41 is formed of the base layer 411, the thermal layer 412, the elastic layer 413, and the surface-release layer 414, each of which is made of a metal material or a synthetic-resin material, stacked on top of one another, the fixing belt 41 has flexibility and mechanical strength, and thus, even in the case where the fixing belt 41 receives a rotational driving torque from the driving portions 48*b* of the flange members 48, the fixing belt 41 is driven so as to smoothly rotate without occurrence of buckling and the like.

As illustrated in FIG. 5, the opposite end portions of a rotary shaft 425 of the pressure roller 42 are rotatably supported on the device frame 452 with bearing members 470, and the pressure roller 42 is pressed into contact with the fixing belt 41 by coil springs 471 that are urging units and that are disposed on the opposite end portions of the rotary shaft 425 with a predetermined press-contact force. In the first exemplary embodiment, as will be described later, in order to improve the productivity of the fixing device 40, a press-contact force of the pressure roller 42 and the pressure pad 43 is set to be higher than that of the related art, and the total load of the two coil springs 471 is set to, for example, about 50 to 80 kgf. Note that the bearing members 470, by which the pressure roller 42 is rotatably supported, are held on the device frame 452 of the fixing device 40 through long holes (not illustrated) in such a manner as to be freely movable in a direction in which the bearing members 470 come into contact with or move away from the fixing belt 41.

The pressure roller 42 is configured to be movable in a direction in which the pressure roller 42 is pressed into contact with or moves away from the fixing belt 41 by a contact/separation mechanism 472, and the contact/separation mechanism 472 is configured to separate the pressure roller 42 from the fixing belt 41 upon heating the fixing belt 41.

Figure 6:
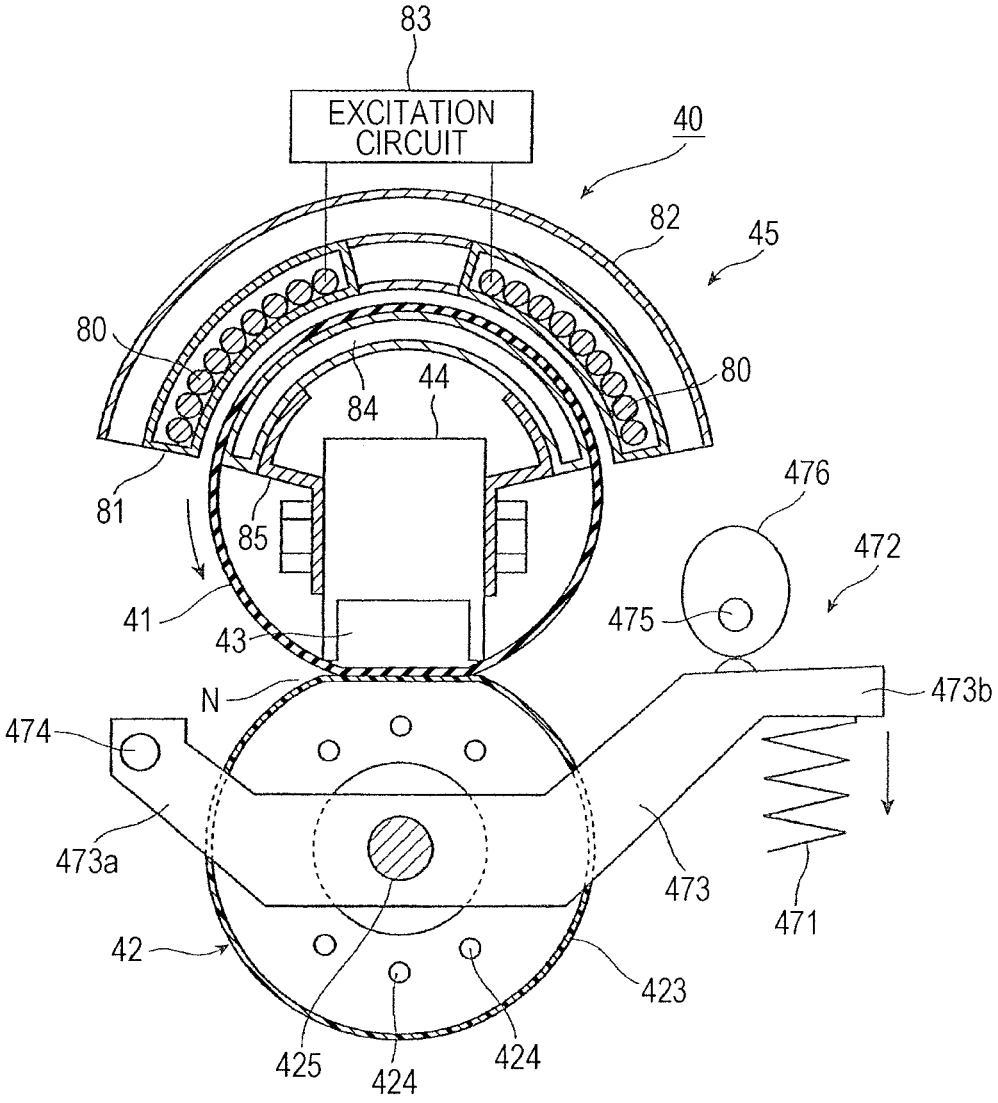
FIG. 6 is a configuration diagram of the fixing device.

As illustrated in FIG. 6, as an example of a specific configuration of the contact/separation mechanism 472, the contact/separation mechanism 472 includes arm members 473 that support the opposite end portions of the rotary shaft 425 of the pressure roller 42 such that the rotary shaft 425 is freely rotatable. First end portions 473*a* of the arm members 473 are each supported so as to be freely rotate around a fulcrum 474, and second end portions 473*b* of the arm members 473 are configured to be pressed by the coil springs 471 in a direction in which the pressure roller 42 is pressed into contact with the fixing belt 41. Eccentric cams 476 that are driven by a rotary shaft 475 so as to rotate are disposed above the second end portions 473*b* of the arm members 473. The eccentric cams 476 are driven so as to rotate at a predetermined timing, so that the second end portions 473*b* of the arm members 473 are pressed down, and as a result, the pressure roller 42 is separated from the fixing belt 41.

As illustrated in FIG. 3, the alternating-magnetic-field-generating device 45, which is disposed adjacent to the fixing belt 41 on the side opposite to the pressure roller 42, includes, for example, excitation coils 80 each of which generates an alternating magnetic field, a holding portion 81 that holds the excitation coils 80 at predetermined positions in such a manner as to form a substantial arc shape, an external-magnetic-path-forming member 82 that is formed in a substantial arc shape and that forms a magnetic path on the side on which the outer periphery of the fixing belt 41 is present among magnetic paths of the alternating magnetic fields generated by the excitation coils 80, and an excitation circuit 83 that excites the excitation coils 80 by supplying a high-frequency current to the excitation coils 80.

As illustrated in FIG. 3, a heat-storage member 84 is disposed in the space enclosed by the fixing belt 41. The heat-storage member 84 is disposed in such a manner as to face the alternating-magnetic-field-generating device 45 with the fixing belt 41 interposed therebetween and is a member that has a heat-storage function that compensates for a decrease in the temperature of the fixing belt 41 by transferring heat onto the fixing belt 41. In addition, the heat-storage member 84 is a member that forms a magnetic path inside an alternating magnetic field generated by the alternating-magnetic-field-generating device 45. Furthermore, the heat-storage member 84 is made of a temperature-sensitive magnetic material whose permeability varies depending on temperature and also has a function of controlling heat generation of the thermal layer 412 of the fixing belt 41. The heat-storage member 84 is formed in an arc shape so as to follow an inner peripheral surface of the fixing belt 41, and the central angle of the arc shape, which follows the inner peripheral surface of the fixing belt 41, is set to, for example, about 160 degrees. The heat-storage member 84 is fixed to the support member 44 with screws 86 via plate-shaped members 85 that are mounted on the opposite end portions of the heat-storage member 84.

<Operation of Image Forming Apparatus>

A basic image forming operation that is to be performed by the image forming apparatus 1 will be described below.

An operation of forming a full-color image, which is a combination of toner images of the four colors (Y, M, C, and K), by using the above-described four image forming devices 10 (Y, M, C, and K) will now be described.

When the image forming apparatus 1 receives command information of a request for an image forming operation (printing), the four image forming devices 10 (Y, M, C, and K), the intermediate transfer device 20, the second transfer device 30, and the fixing device 40 and the like are activated.

In the image forming devices 10 (Y, M, C, and K), first, as illustrated in FIG. 2, the photoconductor drums 11 rotate in a direction indicated by arrow A, and the charging devices 12 charge the surfaces of the corresponding photoconductor drums 11 so as to cause the surfaces to have a certain polarity (negative polarity in the first exemplary embodiment) and a certain electric potential. Next, the exposure devices 13 radiates light beams, which are emitted on the basis of an image signal obtained by converting image information that is input to the image forming apparatus 1 into different color components (Y, M, C, and K), onto the charged surfaces of the photoconductor drums 11, so that electrostatic latent images having the different color components and certain electric potential differences are formed on the surfaces of the photoconductor drums 11.

Subsequently, the image forming devices 10 (Y, M, C, and K) supply toners of the corresponding colors (Y, M, C, and K), which have been charged so as to have a certain polarity (negative polarity), from developing rollers and cause the toners to electrostatically adhere to the corresponding electrostatic latent images, which have been formed on the photoconductor drums 11 and which have the different color components, so as to develop the electrostatic latent images. Through this developing process, the electrostatic latent images, which have been formed on the photoconductor drums 11 and which have the different color components, are developed into visible toner images of the four colors (Y, M, C, and K) with the toners of the corresponding colors.

Next, once the toner images of the different colors, which have been formed on the photoconductor drums 11 of the image forming devices 10 (Y, M, C, and K), have been transported to the corresponding first transfer positions, the first transfer device 15 transfer the corresponding toner images of the different colors onto the intermediate transfer belt 21 of the intermediate transfer device 20, which rotates in the direction indicated by arrow B, in a first transfer process in such a manner that the toner images are sequentially superposed with one another.

After completion of the first transfer process, in the image forming devices 10, the drum cleaning devices 16 clean the surfaces of the corresponding photoconductor drums 11 by scraping off and removing attached substances. This brings the image forming devices 10 into a ready state for the next image forming operation.

Next, in the intermediate transfer device 20, as a result of rotation of the intermediate transfer belt 21, the toner images, which have been transferred to the intermediate transfer belt 21 in the first transfer process, are transported to the second transfer position while being held by the intermediate transfer belt 21. On the other hand, in the sheet-feeding device 50, one of the recording sheets 5 is sent out to the sheet-feeding transport path 56 in accordance with the timing at which the image forming operation is performed. In the sheet-feeding transport path 56, the pair of sheet-transport rollers 55, which are registration rollers, send out and supply the recording sheet 5 to the second transfer position in accordance with the timing at which the toner images are transferred.

In the second transfer position, the second transfer roller 31 of the second transfer device 30 collectively transfers the toner images on the intermediate transfer belt 21 onto the recording sheet 5 in a second transfer process. After completion of the second transfer process, in the intermediate transfer device 20, the belt cleaning device 27 cleans the surface of the intermediate transfer belt 21 by removing attached substances such as residual toner deposited on the surface of the intermediate transfer belt 21 after the second transfer process.

Subsequently, the recording sheet 5, to which the toner images have been transferred in the second transfer process, is transported to the fixing device 40 after being separated from the intermediate transfer belt 21 and the second transfer device 30. In the fixing device 40, the recording sheet 5, which has undergone the second transfer process, is introduced into a contact portion where the fixing belt 41 and the pressure roller 42, which rotate, are in contact with each other, so as to pass through the contact portion, so that necessary fixing treatments (heating and applying pressure) are performed on the recording sheet 5, and the unfixed toner images are fixed onto the recording sheet 5. Finally, in the case of an image forming operation that forms an image on only one surface of the recording sheet 5, the recording sheet 5 to which the toner images have been fixed, is ejected to, for example, the sheet-ejecting section 57, which is positioned above the housing 4*a*, by the pair of sheet-ejection rollers 58.

In the case of forming an image on the two surfaces of one of the recording sheets 5, as a result of the sheet-transport path being switched by the switching gate 63, the recording sheet 5 having an image formed on the front surface thereof is temporarily transported to the second ejecting-transport path 62 by the pair of sheet-ejection rollers 60, and the direction of rotation of the pair of sheet-ejection rollers 60 is switched to the reverse direction while the pair of sheet-ejection rollers 60 is holding the trailing end of the recording sheet 5. The recording sheet 5, which is transported in the reverse direction by the pair of sheet-ejection rollers 60, is transported, through the two-sided printing transport device 64, which includes the pair of sheet-transport rollers 65, to the one or more pairs of sheet-transport rollers 55 in a state where the recording sheet 5 is flipped over. The one or more pairs of sheet-transport rollers 55 send out and supply the recording sheet 5 to the second transfer position in accordance with the timing at which toner images are transferred. Then, an image is formed on the rear surface of the recording sheet 5, and the recording sheet 5 is ejected to the sheet-ejecting section 57, which is positioned above the housing 4*a*, by the pair of sheet-ejection rollers 58.

The recording sheet 5 on which a full-color image, which is a combination of toner images of the four colors, has been formed is output through the above operation.

<Configuration of Subsequent Operation Device>

FIG. 1 is a schematic diagram illustrating a subsequent operation device.

As illustrated in FIG. 1, the subsequent operation device 2 includes the sheet-supply device 7, the folding device 8, and the finisher 9.

The sheet-supply device 7 includes a sheet-transport path 71 that includes a pair of transport rollers 70 that transport one of the recording sheets 5, which is ejected from the image forming apparatus 1, to the folding device 8, which is disposed on a downstream side, and a joining-transport path 73 that joins to the sheet-transport path 71 and that includes a pair of transport rollers 72. The sheet-supply device 7 further includes a sheet-feeding mechanism positioned upstream of the joining-transport path 73, and the sheet-feeding mechanism includes a sheet-accommodating unit 74 in which a front cover, an index sheet, and the like are accommodated in a state of being stacked on top of one another, delivery rollers 75 that send out sheets (not illustrated) from the sheet-accommodating unit 74, separation rollers 76 that separate the sheets, which are sent out by the delivery rollers 75, one by one, and a pair of transport rollers 77 that transport one of the sheets separated by the separation rollers 76.

Figure 7:
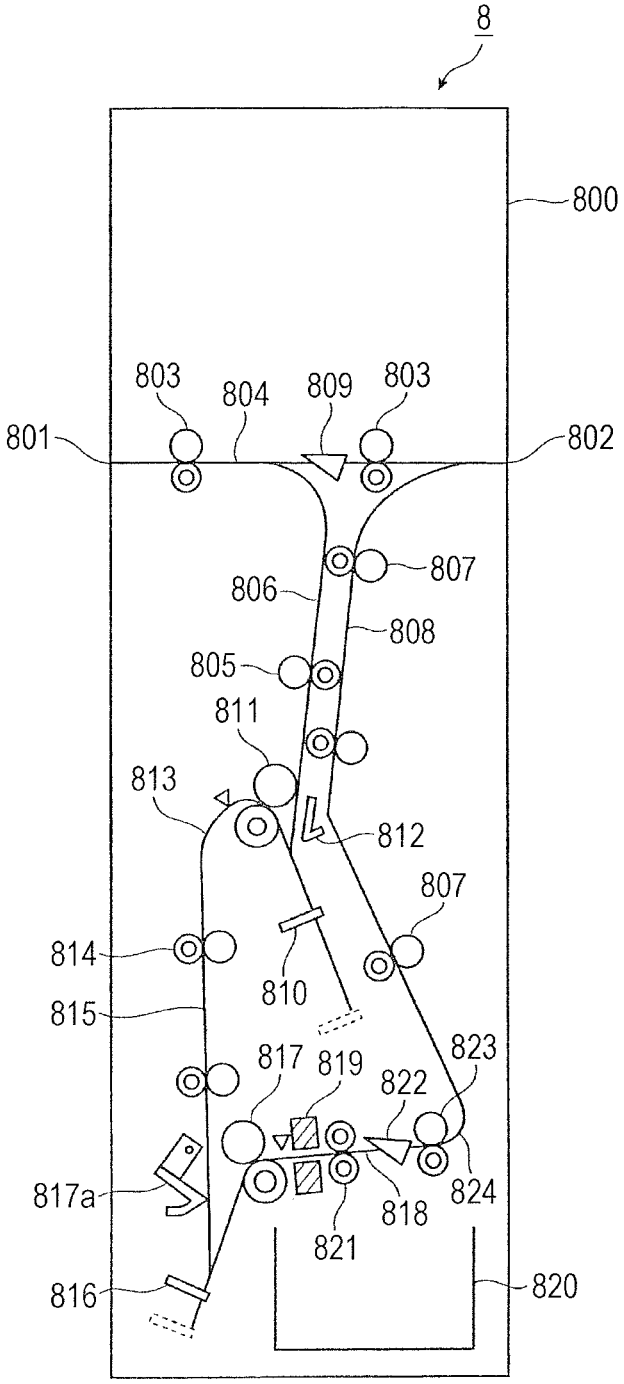
FIG. 7 is a configuration diagram of a folding device.

As illustrated in FIG. 7, in the folding device 8, an introduction port 801 through which the recording sheets 5, which are to be sequentially transported from the sheet-supply device 7, are introduced is formed in a first side surface (left side surface in FIG. 7) of a device body 800, and an ejection port 802 through which the recording sheets 5 are to be ejected to the finisher 9 is formed in a second side surface (right side surface in FIG. 7) of the device body 800. A sheet-transport path 804 extending in the horizontal direction is disposed within the device body 800 so as to connect the introduction port 801 and the ejection port 802. The sheet-transport path 804 includes pairs of sheet-transport rollers 803. An introduction-transport path 806 and an ejection-transport path 808 are disposed at positions in an intermediate portion of the sheet-transport path 804 so as to be approximately parallel to each other, the introduction-transport path 806 extending downward in the vertical direction from the side on which the introduction port 801 is present and including a pair of sheet-ejection rollers 805, and the ejection-transport path 808 extending in the vertical direction from the lower side toward the ejection port 802 and including a pair of sheet-ejection rollers 807. A switching gate 809 that switches a transport path, along which the recording sheets 5 are to be transported, from the sheet-transport path 804 to the introduction-transport path 806 is disposed at a branch at which the sheet-transport path 804 and the introduction-transport path 806 branch.

A first contact member 810 with which the leading end (lower end) of one of the recording sheets 5, which is transported along the introduction-transport path 806, is brought into contact is disposed in a lower end portion of the introduction-transport path 806 so as to be movable in a top-bottom direction. The lower end portion of the introduction-transport path 806, in which the first contact member 810 is disposed, is positioned in a state of being inclined with respect to an upper end portion of the introduction-transport path 806 toward the ejection-transport path 808. In addition, the introduction-transport path 806 includes a first pair of folding rollers 811 that are disposed above the first contact member 810 on one side (left side in FIG. 7). The direction in which the first pair of folding rollers 811 rotate may be switched between a forward direction and a reverse direction. A first folding-guide member 812 that facilitates folding of the recording sheet 5, which has been transported to the introduction-transport path 806, is disposed at a position facing the first pair of folding rollers 811 with the introduction-transport path 806 interposed between the first folding-guide member 812 and the first pair of folding rollers 811 in such a manner as to be rotatable around a rotation fulcrum, which is formed in an upper end portion of the first folding-guide member 812. A first transport path 815 extending downward in the vertical direction is disposed on one side (left side in FIG. 7) of the first pair of folding rollers 811 with a transport path 813, which is curved in a substantially semicircular shape, interposed between the first transport path 815 and the first pair of folding rollers 811. The first transport path 815 includes a pair of sheet-transport rollers 814.

A second contact member 816 with which the leading end (lower end) of the recording sheet 5, which is transported along the first transport path 815, is brought into contact is disposed in a lower end portion of the first transport path 815 in such a manner as to be movable in the top-bottom direction. A second pair of folding rollers 817 are disposed on one side (right side in FIG. 7) of an intermediate portion of the first transport path 815. The direction in which the second pair of folding rollers 817 rotate may be switched between the forward direction and the reverse direction. A second folding-guide member 817*a* that facilitates folding of the recording sheet 5, which has been introduced into the first transport path 815, is disposed at a position facing the second pair of folding rollers 817 with the first transport path 815 interposed between the second folding-guide member 817*a* and the second pair of folding rollers 817 in such a manner as to be rotatable around a rotation fulcrum, which is formed in an upper end portion of the second folding-guide member 817*a*. A second transport path 818 is disposed adjacent to the second pair of folding rollers 817 on the side opposite to the second folding-guide member 817*a* in such a manner as to extend in a substantially horizontal direction.

A pair of holding portions 819 that are disposed adjacent to the second pair of folding rollers 817 and that hold the recording sheet 5 so as to nip the recording sheet 5, a pair of ejection rollers 821 that eject the recording sheet 5, on which the folding operation has been performed, to a sheet-ejection tray 820, a switching gate 822 that performs switching of the transport path along which the recording sheet 5 is to be transported, and a pair of sheet-transport rollers 823 that transport the recording sheet 5 to the ejection-transport path 808 are sequentially disposed along the second transport path 818. The direction in which the pair of ejection rollers 821 rotate may be switched between the forward direction and the reverse direction. An end of the second transport path 818 is connected to a lower end of the ejection-transport path 808 via a curved portion 824.

As illustrated in FIG. 7, in the case where the folding device 8 performs the folding operation on one of the recording sheets 5, the switching gate 809 causes the recording sheet 5, which has been introduced to the interior of the device body 800 through the introduction port 801, to be transported to the introduction-transport path 806. In the case where the folding device 8 does not perform the folding operation on the recording sheet 5, the recording sheet 5, which has been introduced to the interior of the device body 800 through the introduction port 801, is transported along the sheet-transport path 804 and ejected as is through the ejection port 802.

The leading end of the recording sheet 5 that has been transported to the introduction-transport path 806 is stopped by the first contact member 810 that has been moved, in advance, to a position corresponding to a folding position. After that, in the case where the folding operation is performed on the recording sheet 5 by using the first pair of folding rollers 811, the recording sheet 5, which is stopped at a certain position by the first contact member 810, is pressed into a nip part defined between the first pair of folding rollers 811 by the first folding-guide member 812 and then transported while nipped by the first pair of folding rollers 811, so that a first folding operation is performed on the recording sheet 5.

Figure 8A:
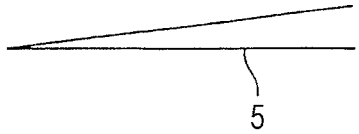
FIGS. 8A to 8D are diagrams each illustrating a folded state of a recording sheet.
Figure 8B:
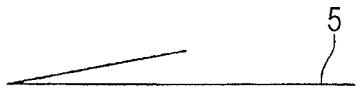
Figure 8C:
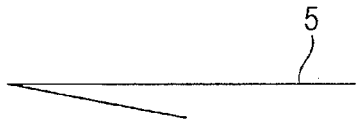
Figure 8D:
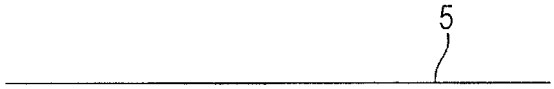
Figure 9A:
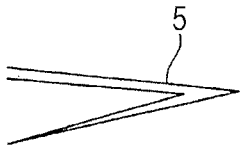
FIGS. 9A to 9D are diagrams each illustrating a folded state of a recording sheet.
Figure 9B:
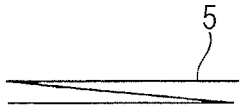
Figure 9C:
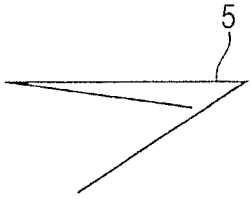
Figure 9D:
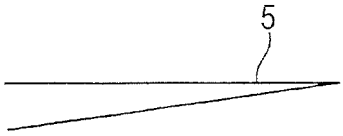

As illustrated in FIGS. 8A to 8C, examples of the first folding operation, which is to be performed on one of the recording sheets 5 by using the first pair of folding rollers 811, include a first half fold that is a method of folding in two the recording sheet 5 along its center, a second half fold that is a method of folding in two a portion of the recording sheet 5 on the trailing end side in a transport direction of the recording sheet 5, and a third half fold that is a method of folding in two a portion of the recording sheet 5 on the leading end side in the transport direction of the recording sheet 5. The second half fold, which is a method of folding in two a portion of the recording sheet 5 on the trailing end side in the transport direction of the recording sheet 5, and the third half fold, which is a method of folding in two a portion of the recording sheet 5 on the leading end side in the transport direction of the recording sheet 5, are performed at a position on the recording sheet 5 away from the leading or trailing end of the recording sheet 5 by a length of approximately one-third of the entire length of the recording sheet 5 in the transport direction. Note that, in the case where only the first half fold, which is a method of folding in two the recording sheet 5 along its center, is performed, as illustrated in FIG. 8D, the recording sheet 5 may be transported as is without performing the folding operation on the recording sheet 5 by using the first pair of folding rollers 811 to the downstream side by the first pair of folding rollers 811 in a state where the transport direction of the recording sheet 5 is reversed, and a second folding operation, which will be described later, may be performed on the recording sheet 5 by using the second pair of folding rollers 817.

Next, the recording sheet 5 on which the first folding operation has been performed by the first pair of folding rollers 811 is transported to the first transport path 815 by the pair of sheet-transport rollers 814 through the transport path 813, which is curved in a substantially semicircular shape.

The leading end (lower end in the transport direction) of the recording sheet 5, which has been transported to the first transport path 815, is stopped by the second contact member 816 that has been moved, in advance, to a position corresponding to a folding position. After that, in the case where the second folding operation is performed on the recording sheet 5 by using the second pair of folding rollers 817, the recording sheet 5, which has been stopped at a certain position by the second contact member 816, is pressed into a nip part defined between the second pair of folding rollers 817 by the second folding-guide member 817*a* and then transported while nipped by the second pair of folding rollers 817, so that the second folding operation is performed on the recording sheet 5.

As illustrated in FIGS. 9A to 9D, examples of the second folding operation, which is to be performed on one of the recording sheets 5 by using the second pair of folding rollers 817, include the folding-in-four method that is a method of further folding in two the recording sheet 5, which has been folded in two by using the first pair of folding rollers 811, along its center, the accordion fold called a Z fold that is a method of folding in two a portion on the distal end side of the recording sheet 5, whose portion on the proximal end side has been folded in two by using the first pair of folding rollers 811, the letter fold called a C fold that is a method of folding in two a portion on the proximal end side of the recording sheet 5, whose portion on the distal end side has been folded in two by using the first pair of folding rollers 811, and a fourth half fold that is a method of folding in two the recording sheet 5, which is flat and on which no folding operation has been performed by using the first pair of folding rollers 811, along its center.

The recording sheet 5, on which the second folding operation has been performed by using the second pair of folding rollers 817, is transported to the second transport path 818 and pressed by the pair of holding portions 819 disposed on the second transport path 818 as necessary, so that a folded portion is precisely folded while the recording sheet 5 is transported by the pair of ejection rollers 821 so as to reciprocate. After that, the recording sheet 5, on which the second folding operation has been performed, is ejected to the sheet-ejection tray 820 by the pair of ejection rollers 821, and the folding operation is completed.

In the case of binding some of the recording sheets 5, on each of which the folding operation has been performed by the folding device 8, or the like, the recording sheets 5, on each of which the folding operation has been performed, are transported to the finisher 9 by the pair of sheet-transport rollers 823 through the curved portion 824 and the ejection-transport path 808.

As illustrated in FIG. 1, in the finisher 9, an introduction port 901 through which the recording sheets 5 are to be introduced is formed in a left side surface of a device body 900, and a pair of transport rollers 902 that are used for transporting the recording sheets 5 are disposed within the device body 900.

A puncher 903 that is a punching unit and that performs a punching operation on the recording sheets 5, which are transported by the pair of transport rollers 902, is arranged immediately after the pair of transport rollers 902. The sheet-transport path branches into two sheet-transport paths, which are a sheet-transport path 904 extending upward and a sheet-transport path 916 extending downward, on a downstream side of the puncher 903. In addition, the sheet-transport path 904, which extends upward, branches into a sheet-transport path 907 that includes a pair of sheet-transport rollers 906 that are used for ejecting the recording sheets 5 as are to an ejection tray 905, which is disposed above the device body 900, and a sheet-transport path 910 that includes a pair of sheet-transport rollers 909 that are used for ejecting the recording sheets 5 to an offset catch tray 908 after a binding operation, which binds end portions of the recording sheets 5, has been performed on the recording sheets 5. The recording sheets 5, which have been transported to the sheet-transport path 910, are aligned on a sheet-aligning tray 913 by a paddle 911, a tamper 912, and the like. After that, the binding operation is performed on the recording sheets 5 by a stapler 914, which binds edges of the recording sheets 5, and the recording sheets 5 are ejected to the offset catch tray 908 by an ejection roller 915 that is disposed so as to be movable in a direction away from the sheet-aligning tray 913. Note that the offset catch tray 908 is configured to automatically move downward as the number of bundles of sheets, which are ejected, increases.

On the other hand, as illustrated in FIG. 1, a sheet-aligning tray 917 that vertically aligns some of the recording sheets 5 in order to bind a set of sheets including the recording sheets 5 into a book by saddle stitching is disposed below the sheet-transport path 916, which extends downward, in a state of being slightly inclined in the vertical direction. In addition, a pairs of transport rollers 918 that are used for transporting the recording sheets 5 are suitably disposed on the sheet-transport path 916. Furthermore, a pair of transport rollers 919 with a paddle that are used for transporting the recording sheets 5 while the recording sheets 5 are aligned are disposed in a lower end portion of the sheet-transport path 916. Note that the sheet-transport path 916, which extends downward, is directly connected to the sheet-transport path 904, which extends upward, via a bypass passage 904*a*. An end guide 920 that positions leading ends (lower ends) of the recording sheets 5 at a predetermined position is disposed in a lower end portion of the sheet-aligning tray 917 so as to be movable in the top-bottom direction, and a paddle 921 that is used for aligning the lower end portions of the recording sheets 5 is also disposed in the lower end portion of the sheet-aligning tray 917. Tampers 922 that align end portions of the recording sheets 5, which are aligned on the sheet-aligning tray 917, in a width direction, which crosses the direction in which the recording sheets 5 are to be transported, are disposed on the opposite sides of an upper end portion of the sheet-aligning tray 917.

A saddle stapler 923 for saddle stitching that performs saddle stitching on the recording sheets 5 aligned on the sheet-aligning tray 917 is disposed on the sheet-aligning tray 917. A center-folding device 926 that includes a knife edge 924 and a pair of center-folding rollers 925 and that performs a center-folding operation on the recording sheets 5, which have been saddle-stitched, is disposed above the saddle stapler 923. The knife edge 924 is driven by a driving unit 927 so as to be retractable in a direction that crosses the sheet-aligning tray 917. The recording sheets 5 on which the center-folding operation has been performed by the center-folding device 926 are sequentially ejected to a sheet-stacking device 930 by a pair of ejection rollers 928 through an ejecting-transport path 929.

Figure 10:
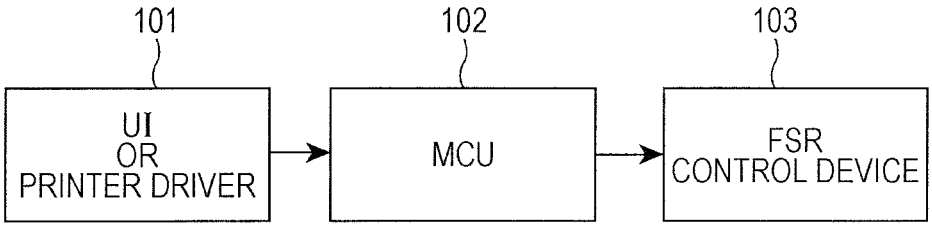
FIG. 10 is a block diagram illustrating a control circuit.

FIG. 10 is a block diagram illustrating a control circuit of the image forming system 100.

In FIG. 10, reference numeral 101 denotes a user interface (UI), which is mounted in the image forming apparatus 1, or a printer driver, which is installed in a host computer (not illustrated) or the like, reference numeral 102 denotes a micro controller unit (MCU), which is an example of a switching unit and which is included in the image forming apparatus 1, and reference numeral 103 denotes a finisher-control device that is included in the finisher 9 of the subsequent operation device 2.

Figure 11:
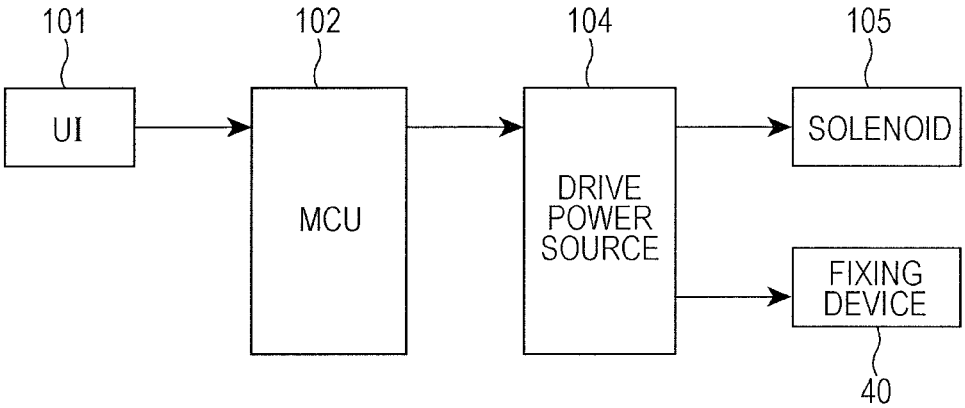
FIG. 11 is a block diagram illustrating a control circuit.

FIG. 11 is a block diagram illustrating a control circuit of the image forming apparatus 1.

In FIG. 11, reference numeral 102 denotes an MCU that integrally controls the above-described operation of the image forming apparatus 1. Although not illustrated, the MCU 102 includes a central processing unit (CPU), a read only memory (ROM), a random access memory (RAM), and a bus and a communication interface that connect the CPU, the ROM, and the like.

The MCU 102 controls a solenoid 105, which drives the switching gate 63 of the image forming apparatus 1 so that the switching gate 63 is switched, via a drive power source 104 and controls a change in a fixation temperature of the fixing device 40 via the drive power source 104. The drive power source 104 controls the fixation temperature of the fixing belt 41 by changing the current value and the frequency of a high-frequency current that is applied to the alternating-magnetic-field-generating device 45 of the fixing device 40. The UI 101 is used by a user when the user instructs, for example, the image forming apparatus 1 to perform an image forming operation or the subsequent operation device 2 to perform a subsequent operation.

<Operation of Image Forming Apparatus>

Operations of the image forming apparatus 1 and the subsequent operation device 2 will now be described.

As illustrated in FIG. 1, in the case where a subsequent operation of the subsequent operation device 2, particularly the folding operation of the folding device 8 is specified to be performed on one of the recording sheets 5 on which an image has been formed by the image output device 4, the image forming apparatus 1 operates in the following manner.

For example, when a tri-fold (C-fold) operation, which is a method of inwardly folding in three an image surface of the recording sheet 5 and which is to be performed by the folding device 8, is specified by the UI 101, even in the case of forming an image on one surface of the recording sheet 5, as illustrated in FIG. 11, the MCU 102 drives the solenoid 105, which switches the switching gate 63 of the image forming apparatus 1 via the drive power source 104. As a result, the recording sheet 5, which has an image formed on one surface thereof, will not be immediately transported to the subsequent operation device 2 by the pair of sheet-ejection rollers 60 via the second ejecting transport path 62 and is transported to the two-sided printing transport device 64.

The recording sheet 5, which has been transported to the two-sided printing transport device 64, is flipped over by being transported along the two-sided printing transport device 64 and transported to the second transfer position of the intermediate transfer device 20 by the one or more pairs of sheet-transport rollers 55. Then, toner images will not be transferred onto the recording sheet 5 from the intermediate transfer belt 21 at the second transfer position of the intermediate transfer device 20, and the recording sheet 5 is transported to the fixing device 40. In this case, the curl (curvature) generated in the recording sheet 5, which has an image formed on one surface thereof, is corrected during the period when the recording sheet 5 is transported along the two-sided printing transport device 64, which is curved in a direction opposite to the direction in which the curved portion 62*a* of the second ejecting transport path 62 is curved.

Figure 12:
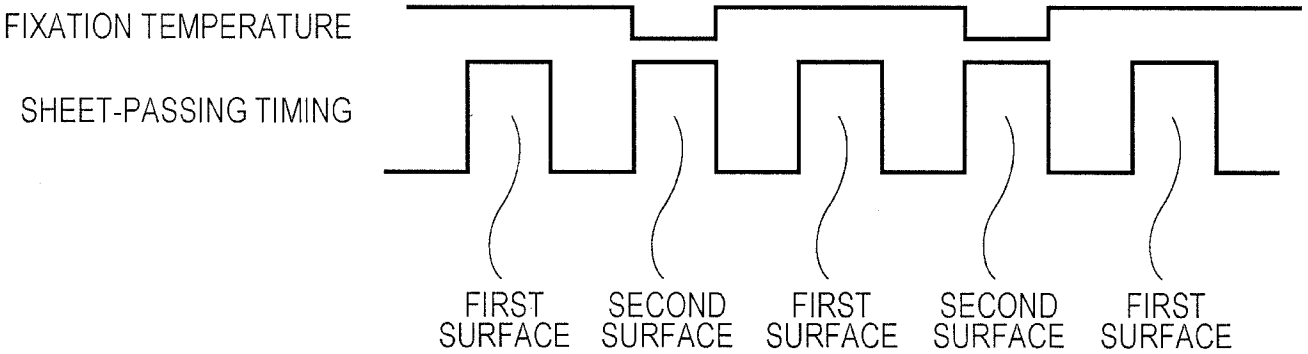
FIG. 12 is a timing chart illustrating operation of the image forming apparatus according to the first exemplary embodiment of the present invention.

In this case, as illustrated in FIG. 12, in the fixing device 40, the heating temperature of the fixing belt 41 is changed to a second temperature that is about 140° C. to about 150° C. and that is lower than the temperature (e.g., 160° C.) at which a normal image formation is performed. After that, as a result of the switching gate 63 switching the transport path, the recording sheet 5, which has passed through the fixing device 40, is transported to the subsequent operation device 2 by the pair of sheet-ejection rollers 60 via the second ejecting transport path 62.

Subsequently, as illustrated in FIG. 1 and FIG. 7, the recording sheet 5, which has been transported to the subsequent operation device 2, is transported to the folding device 8 via the sheet-supply device 7, and a subsequent operation such as a tri-fold operation specified by the UI 101 is performed on the recording sheet 5 by the folding device 8.

As described above, in the image forming apparatus 1 according to the first exemplary embodiment, when a folding operation, such as a tri-fold operation, is specified to be performed on one of the recording sheets 5, on which an image has been formed, by the folding device 8 of the subsequent operation device 2, even in the case of forming an image on one surface of the recording sheet 5, after the recording sheet 5, which has an image formed on one surface thereof, has been transported to the two-sided printing transport device 64, the recording sheet 5 is caused to pass through the fixing device 40 and transported to the subsequent operation device 2 by the pair of sheet-ejection rollers 60 through the second ejecting transport path 62. In this case, the fixation temperature of the fixing device 40 is changed to the second temperature, which is lower than the temperature at which a normal image formation is performed.

Thus, even in the case where an image surface of the recording sheet 5, to which toner images have been transferred, is inwardly or outwardly curved (curled) when the recording sheet 5 is ejected through the second ejecting transport path 62 including the curved portion 62*a* after the recording sheet 5 has undergone a heating and fixing treatment performed by the fixing device 40, the curvature (curl) of the recording sheet 5 is corrected, and the recording sheet 5 is brought into a state close to a flat state by passing through the two-sided printing transport device 64, which is curved in a direction opposite to the direction in which the curved portion 62*a* of the second ejecting transport path 62 is curved.

Accordingly, the curvature of the recording sheet 5, which is transported to the subsequent operation device 2 via the second ejecting transport path 62 of the image forming apparatus 1, is corrected, and the recording sheet 5 is brought into a state close to a flat state.

Second Exemplary Embodiment

Figure 13:
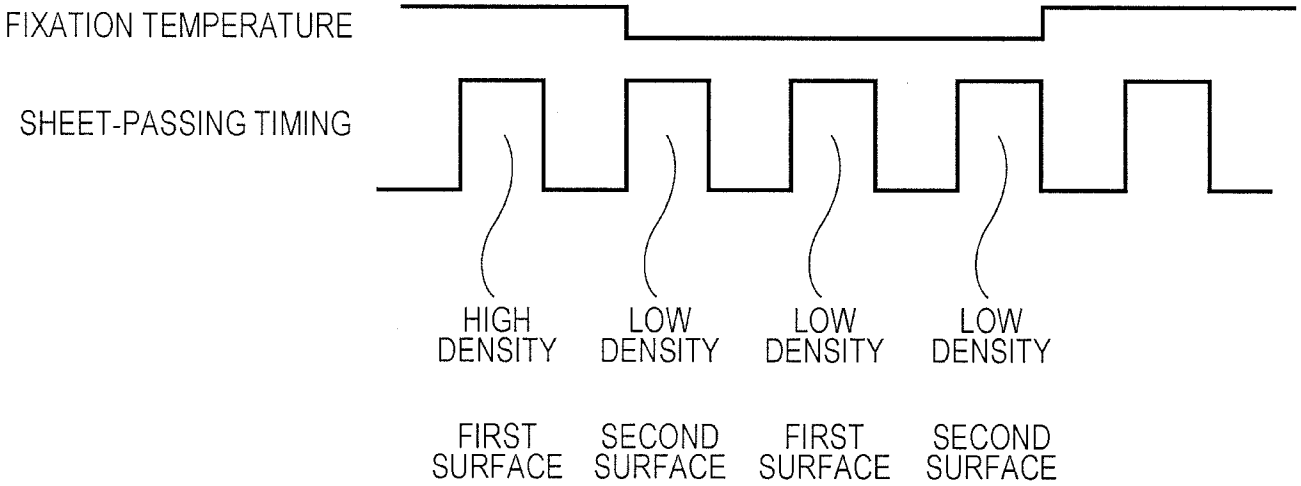
FIG. 13 is a timing chart illustrating operation of an image forming apparatus according to a second exemplary embodiment of the present invention.

FIG. 13 is a diagram illustrating operation of an image forming apparatus according to a second exemplary embodiment of the present invention.

In the second exemplary embodiment, as illustrated in FIG. 13, when the subsequent operation device 2 performs a subsequent operation on one of the recording sheets 5, on which an image has been formed by the image forming apparatus 1, and an image is formed on the two surfaces of the recording sheet 5, the MCU 102 causes an image-density sensor (not illustrated) to sense the density of an image formed on the rear surface of the recording sheet 5.

As the image-density sensor, a density sensor that directly senses, on the recording sheet 5 or on the intermediate transfer belt 21, the density of the image formed on the rear surface of the recording sheet 5, is used. Alternatively, a unit that senses the density of the image formed on the rear surface of the recording sheet 5 by acquiring the density of the image from image data may be used as the image-density sensor.

When it is determined that the density of the image formed on the rear surface of the recording sheet 5 is a low density, which is lower than a predetermined threshold, as illustrated in FIG. 13, when the fixing device 40 fixes toner images onto the rear surface of the recording sheet 5, the MCU 102 changes the fixation temperature of the fixing device 40 to the second temperature, which is lower than the temperature at which a normal image formation is performed.

Note that although, in the above-described first exemplary embodiment, the fixing device 40 is configured such that the fixation temperature of the fixing device 40 is changed to the second temperature, which is lower than the temperature at which a normal image formation is performed, the fixing device 40 may be configured to stop heating.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner image forming unit configured to form a toner image on a recording medium;

a fixing unit configured to heat and fix the toner image, which has been formed on the recording medium by the toner image forming unit, onto the recording medium;

an ejection unit configured to eject the recording medium, to which the toner image has been fixed by the fixing unit, through a curved transport path;

a transport unit for two-sided printing, wherein the transport unit is configured to flip over the recording medium, to which the toner image has been fixed by the fixing unit, and transport the recording medium to the toner image forming unit; and a switching unit configured to, in response to a subsequent operation being specified to be performed on the recording medium, to which the toner image has been fixed by the fixing unit on a first side surface of the recording medium:

switch an ejection path through which the recording medium is to be ejected to an ejection path that passes through the transport unit for two-sided printing; and change a temperature of the fixing unit for heating a second side surface of the recording medium to a temperature lower than a temperature at which the toner image is fixed to the recording medium.

2. The image forming apparatus according to claim 1, wherein the subsequent operation to be performed on the recording medium is a tri-fold operation that is a method of inwardly folding in three an image surface of the recording medium.

3. The image forming apparatus according to claim 1, wherein the switching unit is configured to, in response to the subsequent operation being specified, switch the ejection path through which the recording medium is to be ejected to the ejection path that passes through the transport unit for two-sided printing even in a case wherein only one-sided printing is to be performed.

4. The image forming apparatus according to claim 1, wherein the ejection path that passes through the transport unit for two-sided printing is curved in a direction opposite to that of an ejection path through which the recording medium is to be ejected to a device for performing the subsequent operation specified on the recording medium.

5. An image forming apparatus comprising:

a toner image forming unit configured to form a toner image on a recording medium;

a fixing unit configured to fix the toner image, which has been formed on the recording medium by the toner image forming unit, onto the recording medium;

an ejection unit configured to eject the recording medium, to which the toner image has been fixed by the fixing unit, through a curved transport path;

a transport unit for two-sided printing, wherein the transport unit is configured to flip over the recording medium, to which the toner image has been fixed by the fixing unit, and transport the recording medium to the toner image forming unit; and a switching unit configured to, in response to a subsequent operation being specified to be performed on the recording medium, to which the toner image has been fixed by the fixing unit on a first side surface of the recording medium, switch an ejection path through which the recording medium is to be ejected to an ejection path that passes through the transport unit for two-sided printing and that passes through the fixing unit for heating a second side surface of the recording medium.

* * * * *